US011230918B2

(12) United States Patent
Gooneratne et al.

(10) Patent No.: US 11,230,918 B2
(45) Date of Patent: Jan. 25, 2022

(54) SYSTEMS AND METHODS FOR CONTROLLED RELEASE OF SENSOR SWARMS DOWNHOLE

(71) Applicant: Saudi Arabian Oil Company, Dhahran (SA)

(72) Inventors: Chinthaka Pasan Gooneratne, Dhahran (SA); Jothibasu Ramasamy, Dhahran (SA); Bodong Li, Dhahran (SA); Guodong Zhan, Dhahran (SA); Timothy Eric Moellendick, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 39 days.

(21) Appl. No.: 16/720,879

(22) Filed: Dec. 19, 2019

(65) Prior Publication Data

US 2021/0189863 A1 Jun. 24, 2021

(51) Int. Cl.

| | |
|---|---|
| ***E21B 47/09*** | (2012.01) |
| ***E21B 44/00*** | (2006.01) |
| ***E21B 47/12*** | (2012.01) |

(52) U.S. Cl.

CPC ..... *E21B 47/09* (2013.01); *E21B 44/005* (2013.01); *E21B 47/12* (2013.01)

(58) Field of Classification Search

None

See application file for complete search history.

(56) References Cited

U.S. PATENT DOCUMENTS

| | | | |
|---|---|---|---|
| 4,760,882 | A | 8/1988 | Novak |
| 7,273,102 | B2 | 9/2007 | Sheffield |
| 7,503,398 | B2 | 3/2009 | Logiudice et al. |
| 7,510,001 | B2 | 3/2009 | Spring et al. |
| 7,931,091 | B2 | 4/2011 | Bailey et al. |

(Continued)

FOREIGN PATENT DOCUMENTS

| | | | |
|---|---|---|---|
| CA | 2894558 | A1 | 8/2014 |
| CA | 2929482 | A1 | 6/2015 |

(Continued)

OTHER PUBLICATIONS

International Search Report and Written Opinion for International Application No. PCT/US2020/065736, report dated Mar. 25, 2021; pp. 1-13.

(Continued)

*Primary Examiner* — Caroline N Butcher

(74) *Attorney, Agent, or Firm* — Bracewell LLP; Constance G. Rhebergen; Linda L. Morgan

(57) ABSTRACT

Methods and systems for monitoring conditions within a wellbore of a subterranean well include extending a drill string into the subterranean well from a terranean surface. The drill string has an actuator assembly, a sensor compartment, and a plurality of sensors located within the sensor compartment. The actuator assembly is instructed to transmit a swarm release signal to a central power unit of the sensor compartment so that the central power unit of the sensor compartment releases certain of the plurality of sensors from the sensor compartment. Data from the sensors is transferred to a data processing system after the sensors reach the terranean surface.

16 Claims, 13 Drawing Sheets

(56) References Cited

U.S. PATENT DOCUMENTS

| | | | | |
|---|---|---|---|---|
| 8,016,036 | B2 | 9/2011 | Kirkwood et al. | |
| 8,122,950 | B2 | 2/2012 | Daniel et al. | |
| 8,215,393 | B2 | 7/2012 | Mackay et al. | |
| 8,284,075 | B2 | 10/2012 | Fincher et al. | |
| 8,394,464 | B2 | 3/2013 | Bailey et al. | |
| 8,639,186 | B2 | 1/2014 | Ayers | |
| 8,800,880 | B2 | 8/2014 | Christiansen | |
| 9,115,573 | B2 | 8/2015 | Purkis et al. | |
| 9,382,769 | B2 | 7/2016 | Wilson et al. | |
| 9,488,046 | B2 | 11/2016 | Purkis | |
| 9,506,326 | B2 | 11/2016 | Hay et al. | |
| 9,567,819 | B2 | 2/2017 | Cavender et al. | |
| 9,574,439 | B2 | 2/2017 | Joseph et al. | |
| 9,677,371 | B2 | 6/2017 | Richards et al. | |
| 9,822,611 | B2 | 11/2017 | Delzell et al. | |
| 9,890,319 | B2 | 2/2018 | Ezell et al. | |
| 9,970,246 | B2 | 5/2018 | Hoelscher et al. | |
| 10,000,681 | B2 | 6/2018 | Livanec et al. | |
| 10,047,604 | B2 | 8/2018 | Graves et al. | |
| 10,053,978 | B2 | 8/2018 | Hay et al. | |
| 2009/0090514 | A1 | 4/2009 | Bailey et al. | |
| 2010/0263867 | A1 | 10/2010 | Horton et al. | |
| 2011/0048697 | A1 | 3/2011 | Lewis et al. | |
| 2011/0284245 | A1 | 11/2011 | Crandall et al. | |
| 2013/0118733 | A1* | 5/2013 | Kumar | E21B 47/26 166/254.2 |
| 2013/0126164 | A1 | 5/2013 | Sweatman et al. | |
| 2013/0284518 | A1 | 10/2013 | Wu et al. | |
| 2014/0318806 | A1* | 10/2014 | Machocki | E21B 34/10 166/373 |
| 2015/0114646 | A1 | 4/2015 | Hoelscher et al. | |
| 2016/0053572 | A1 | 2/2016 | Snoswell | |
| 2016/0164437 | A1 | 6/2016 | Kim et al. | |
| 2016/0244654 | A1 | 8/2016 | Way et al. | |
| 2017/0015887 | A1 | 1/2017 | Stefano et al. | |
| 2017/0159363 | A1 | 6/2017 | Lazarev et al. | |
| 2017/0183938 | A1 | 6/2017 | Inglis | |
| 2017/0247607 | A1 | 8/2017 | Hundt | |
| 2017/0292371 | A1 | 10/2017 | Hay | |
| 2017/0293044 | A1 | 10/2017 | Gilstrap et al. | |
| 2017/0322341 | A1 | 11/2017 | Galliano et al. | |
| 2017/0342826 | A1 | 11/2017 | Wilson et al. | |
| 2018/0030824 | A1 | 2/2018 | Roberson et al. | |
| 2018/0051700 | A1 | 2/2018 | Sheth et al. | |
| 2018/0082090 | A1 | 3/2018 | Roberson et al. | |
| 2018/0262127 | A1* | 9/2018 | Gooneratne | E21B 47/12 |
| 2019/0031951 | A1 | 1/2019 | Johnson et al. | |
| 2019/0093459 | A1 | 3/2019 | Mau et al. | |
| 2020/0208510 | A1 | 7/2020 | Guijt et al. | |

FOREIGN PATENT DOCUMENTS

| | | | |
|---|---|---|---|
| DE | 60305190 | T2 | 11/2006 |
| EP | 2501032 | A2 | 9/2012 |
| WO | 2011041562 | A2 | 4/2011 |
| WO | 2012122178 | A2 | 9/2012 |
| WO | 2012154473 | A1 | 11/2012 |
| WO | 2015040241 | | 3/2015 |
| WO | 2016043979 | A1 | 3/2016 |
| WO | 2018013312 | A1 | 1/2018 |
| WO | 2019005556 | A1 | 1/2019 |

OTHER PUBLICATIONS

International Search Report and Written Opinion for Internaltion Application No. PCT/US2020/066221 report dated Mar. 29, 2021; pp. 1-12.

International Search Report and Written Opinion for International Application No. PCT/US2020/066136 report dated Apr. 13, 2021; pp. 1-11.

International Search Report and Written Opinion for International Application No. PCT/US2020/065808 report dated Apr. 15, 2021; pp. 1-12.

* cited by examiner

SYSTEMS AND METHODS FOR CONTROLLED RELEASE OF SENSOR SWARMS DOWNHOLE

BACKGROUND

1. Field of the Disclosure

The present disclosure relates in general to subterranean well developments, and more particularly to actuation and sensing systems for gathering downhole information.

2. Description of the Related Art

When drilling a subterranean well, operators are unable to view the trajectory of the wellbore and the downhole environment directly. In addition, once tools, instruments, equipment, and other devices are lowered in the wellbore they are inaccessible from the surface.

Logging and directional instruments can have sensors and instrumentation that are designed to work in harsh downhole environments and can assist in understanding the downhole drilling environment. Current systems for measuring downhole data include wireline logging, logging while drilling, and measurement while drilling techniques. Signals from measurement while drilling and logging while drilling operations can be communicated by mud-pulse telemetry.

SUMMARY OF THE DISCLOSURE

Wireline logging is expensive due to the time spent on performing a wireline logging operation as well as the expensive sensors and packaging. Moreover, there is always the risk of a wireline logging tool getting stuck in the hole, which could significantly add to the cost of drilling a well. Measurement while drilling and logging while drilling tools are also very expensive, bulky and mud pulse telemetry is very slow (only up to 20 bits/second). The power to the measurement while drilling and logging while drilling tools and the mud pulse telemetry unit is provided by a turbine/alternator. The power generation turbine used in a logging while drilling system, if installed close to the mud pulser and above the logging while drilling tool, may prevent the retrieval of radioactive chemical sources in the logging while drilling tool if the drilling bottomhole assembly gets stuck and cannot be retrieved.

Embodiments of this disclosure include systems and methods that deploy a sensor swarm system that can be controlled from the surface to monitor the wellbore in real time. The system has a downhole actuation system and a digitally enabled compartment to store the sensor swarm. The downhole actuation system can be controlled from the surface to release the sensor swarm into the wellbore. The swarm consists of many miniature microelectromechanical systems (MEMS) sensors that can acquire the downhole parameters. Compared to measurement while drilling and logging while drilling tools, the sensor swarms occupy much less space in a bottom hole assembly, do not require large lithium batteries, can be mass produced at a lower cost, and are mobile.

In an embodiment of this disclosure, a method for monitoring conditions within a wellbore of a subterranean well include extending a drill string into the subterranean well from a terranean surface. The drill string has an actuator assembly, a sensor compartment, and a plurality of sensors located within the sensor compartment. The actuator assembly is instructed to transmit a swarm release signal to a central power unit of the sensor compartment so that the central power unit of the sensor compartment releases certain of the plurality of sensors from the sensor compartment. Data from the certain of the plurality of sensors is transferred to a data processing system after the sensors reach the terranean surface.

In alternate embodiments, instructing the actuator assembly to transmit the swarm release signal to the central power unit can include rotating the drill string in a predetermined swarm release signal pattern. The actuator assembly can have a first pipe member with a segment formed of a first material. A second pipe member can circumscribe the first pipe member. A bearing can be positioned between the first pipe member and the second pipe member. The bearing can be formed of a second material, where the first material is reactive to the second material. The actuator assembly can be instructed to transmit the swarm release signal to the central power unit, which can include rotating the first pipe member relative to the second pipe member and interpreting a pattern of a reaction of the segment as the bearing rotates past the segment.

In other alternate embodiments, each of the sensors of the plurality of sensors can be a miniature microelectromechanical systems sensor. The miniature microelectromechanical systems sensor can include a microelectromechanical sensing element, a microprocessor, a signal processor, a transceiver, and a power source located within an outer shell. Each of the sensors of the plurality of sensors can be retained within the sensor compartment by an electromagnet. Releasing the certain of the plurality of sensors from the sensor compartment can include stopping a delivery of power to the electromagnet of each of the certain of the plurality of sensors. Weight elements can be added to the certain of the plurality of sensors before the sensor compartment releases the certain of the plurality of sensors from the sensor compartment. Each of the plurality of sensors can have a unique location identifier and instructing the actuator assembly to transmit the swarm release signal to the central power unit can include providing the unique location identifier of each of the certain of the plurality of sensors to be released from the sensor compartment.

In an alternate embodiment, a system for monitoring conditions within a wellbore of a subterranean well includes a drill string extending into the subterranean well from a terranean surface. The drill string has an actuator assembly, a sensor compartment, and a plurality of sensors located within the sensor compartment. A data processing system located at the terranean surface is operable to receive data from certain of the plurality of sensors. The actuator assembly is operable to transmit a swarm release signal to a central power unit of the sensor compartment so that the central power unit of the sensor compartment releases the certain of the plurality of sensors from the sensor compartment.

In alternate embodiments, the actuator assembly can have a first pipe member with a segment formed of a first material. A second pipe member can circumscribe the first pipe member. A bearing can be positioned between the first pipe member and the second pipe member. The bearing can be formed of a second material, where the first material can be reactive to the second material. The central power unit can be operable to release the certain of the plurality of sensors from the sensor compartment by receiving the swarm release signal from the actuator assembly that is generated by rotating the first pipe member relative to the second pipe member. A pattern of a reaction of the segment as the bearing rotates past the segment can be interpreted. Each of the sensors of the plurality of sensors can be a miniature microelectromechanical systems sensor.

In another alternate embodiment of this disclosure, a method for actuating a downhole device within a subterranean well includes extending a tubular string into the subterranean well from a terranean surface. The tubular string has an actuator assembly. The actuator assembly is instructed to transmit a signal to the downhole device, directing the downhole device to perform a function. The actuator assembly has a first pipe member with a segment formed of a first material. A second pipe member circumscribes the first pipe member. A bearing is positioned between the first pipe member and the second pipe member, the bearing formed of a second material. The first material is reactive to the second material. Instructing the actuator assembly to transmit the signal to the downhole device includes rotating the tubular string to rotate the first pipe member relative to the second pipe member in a predetermined pattern, and interpreting a resulting reaction of the segment as the bearing rotates past the segment.

In alternate embodiments, the segment can be located on an outer diameter surface of the first pipe member and can be axially aligned with a side bearing. The side bearing can be located between the outer diameter surface of the first pipe member and an inner diameter surface of the second pipe member. The segment can be positioned at and end surface of the first pipe member and can be radially aligned with an end bearing. The end bearing can be located between the end surface of the first pipe member and a support member secured to the second pipe member that extends radially from the second pipe member.

In yet another alternate embodiment of this disclosure, a system for actuating a downhole device within a subterranean well includes a tubular string extending into the subterranean well from a terranean surface. The tubular string has an actuator assembly. The actuator assembly has a first pipe member with a segment formed of a first material. A second pipe member circumscribes the first pipe member. A bearing is positioned between the first pipe member and the second pipe member. The bearing is formed of a second material, where the first material is reactive to the second material. The actuator assembly is operable to receive instructions to transmit a signal to the downhole device, directing the downhole device to perform a function. The tubular string is operable to rotate the first pipe member relative to the second pipe member in a predetermined pattern, causing a resulting reaction of the segment as the bearing rotates past the segment for instructing the actuator assembly to transmit the signal to the downhole device.

In alternate embodiments, the segment can be located on an outer diameter surface of the first pipe member and can be axially aligned with a side bearing. The side bearing can be located between the outer diameter surface of the first pipe member and an inner diameter surface of the second pipe member. A support member can extend radially inward from an inner diameter surface of the second pipe member, the support member supporting the first pipe member within a central bore of the second pipe member. The segment can be positioned at and end surface of the first pipe member and can be radially aligned with an end bearing. The end bearing can be located between the end surface of the first pipe member and the support member.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
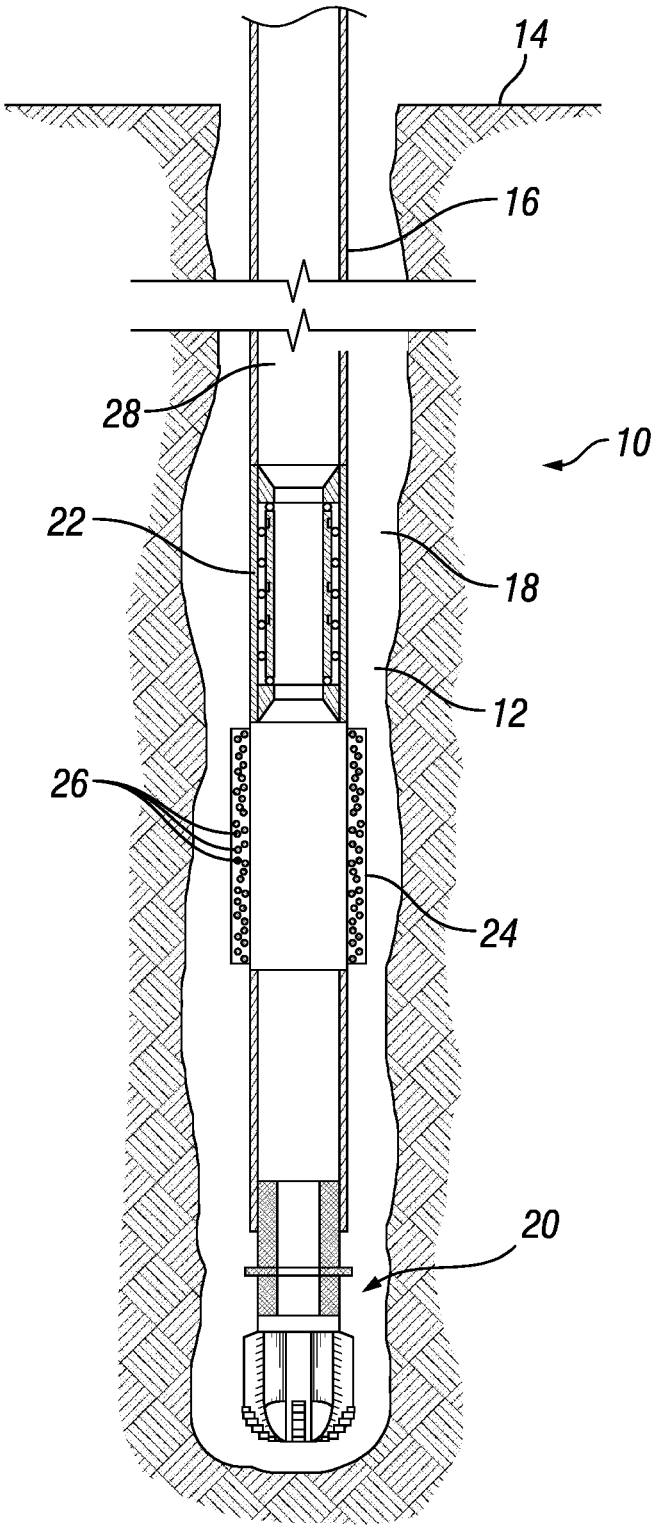
FIG. 1 is a section view of a subterranean well with a drill string having an actuator assembly and a sensor compartment, in accordance with an embodiment of this disclosure.

Looking at FIG. 1, subterranean well 10 can have wellbore 12 that extends to an earth's or terranean surface 14. Subterranean well 10 can be an offshore well or a land based well and can be used for producing hydrocarbons from subterranean hydrocarbon reservoirs, or can be otherwise associated with hydrocarbon development activities.

Drill string 16 can extend into and be located within wellbore 12. Annulus 8 is defined between an outer diameter surface of drill string 16 and the inner diameter of wellbore 12. Drill string 16 can include a string of tubular joints and bottom hole assembly 20. The tubular joints can extend from terranean surface 14 into subterranean well 10. Bottom hole assembly 20 can include, for example, drill collars, stabilizers, reamers, shocks, a bit sub and the drill bit. Drill string 16 can be used to drill wellbore 12. Drill string 16 has a string bore 28 that is a central bore extending the length of drill string 16. Drill string 16 can be rotated to rotate the bit to drill wellbore 12.

Drill string 16 can further include actuator assembly 22, sensor compartment 24, and a plurality of sensors 26 located within sensor compartment 24. Actuator assembly and sensor compartment 24 can be installed as drilling subs that are part of the drill string assembly. In the example embodiment of FIG. 1, actuator assembly 22 is shown extending radially into string bore 28 of drill string 16. In alternate embodiments, actuator assembly 22 can be located on an outer diameter surface of drill string 16. In the example embodiment of FIG. 1, sensor compartment 24 is shown located on the outer diameter surface of drill string 16. In alternate embodiments, sensor compartment 24 can extend radially into string bore 28 of drill string 16.

Figure 3:
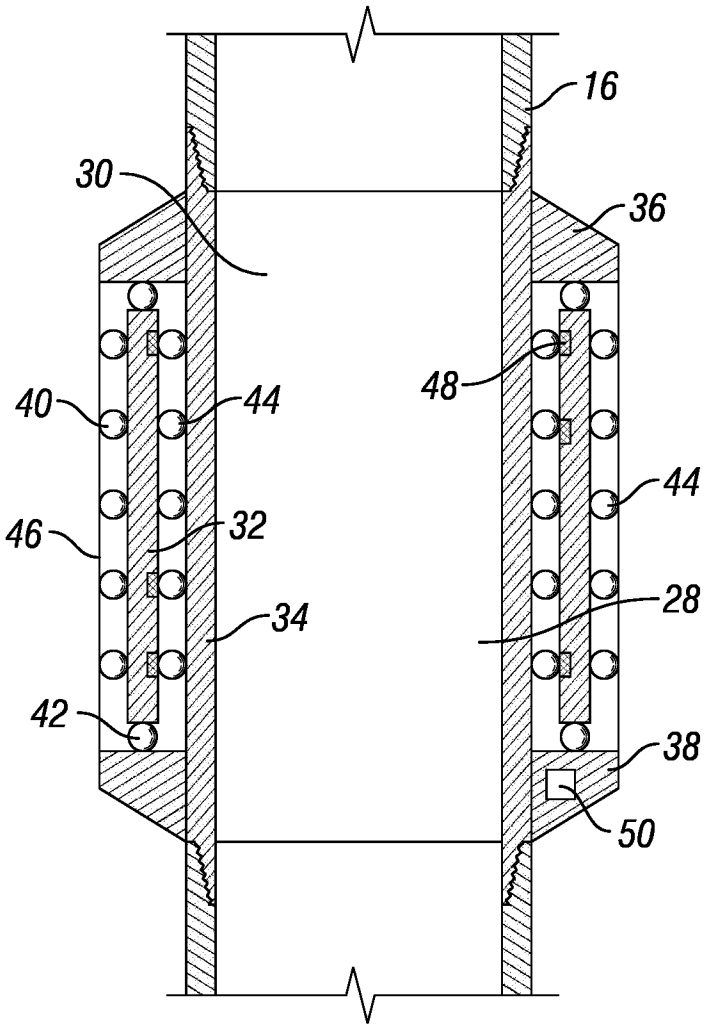
FIG. 3 is a section view of an actuator assembly, in accordance with an alternate embodiment of this disclosure.
Figure 2:
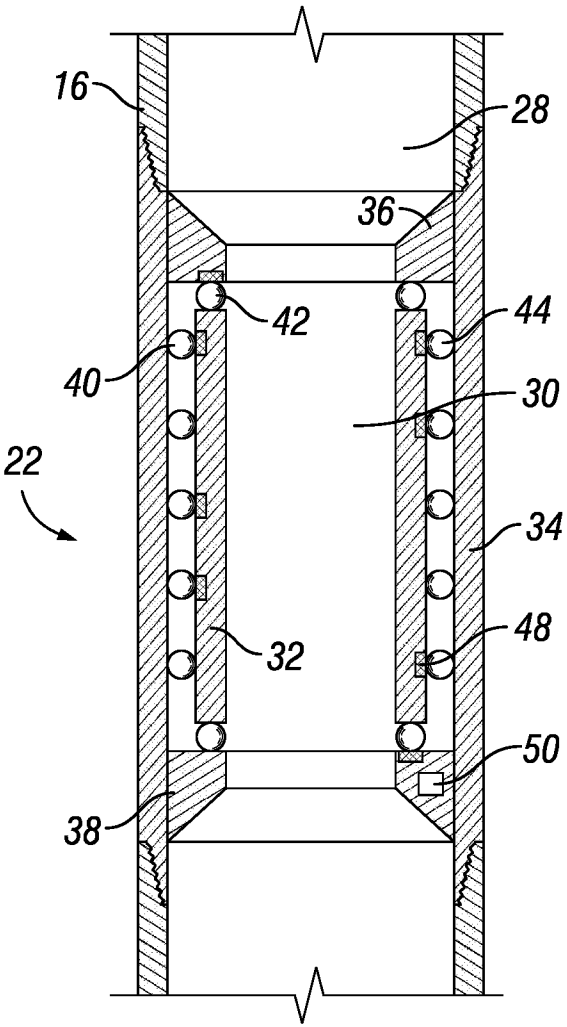
FIG. 2 is a section view of an actuator assembly, in accordance with an embodiment of this disclosure.

Looking at FIGS. 2 and 3, actuator assembly 22 is a tubular shaped actuator assembly with an actuator bore 30. Actuator assembly 22 can be secured to a downhole end of a joint of drill string 16. Actuator assembly 22 has an actuator bore 30 that extends axially the length of actuator assembly 22. The drilling fluid can flow through the drill string 16, including actuator assembly 22, out the drill bit, up annulus 18, and back up to terranean surface 14.

Actuator assembly 22 includes first pipe member 32 and second pipe member 34. First pipe member 32 and second pipe member are co-axially oriented. Second pipe member 34 can be secured to the downhole end of a joint of drill string 16 so that second pipe member 34 rotates with drill string 16. Second pipe member 34 can have a diameter that is substantially similar or the same as the diameter of an adjacent joint of drill string 16. First pipe member 32 can be supported by second pipe member 34. First pipe member 32 can, for example, be supported between uphole support 36 and downhole support 38. Uphole support 36 and downhole support 38 can extend radially from second pipe member 34.

In the embodiment of FIG. 2, actuator bore 30 is smaller than string bore 28 of adjacent joints of drill string 16 and defines the fluid flow path through actuator assembly 22. The diameter of first pipe member 32 is smaller than the diameter of second pipe member 34. Second pipe member 34 circumscribes first pipe member 32. Uphole support 36 and downhole support 38 extend radially inward from an inner diameter surface of second pipe member 34.

In the embodiment of FIG. 3 actuator bore 30 has a substantially similar diameter as string bore 28 of adjacent joints of drill string 16 and defines the fluid flow path through actuator assembly 22. The diameter of first pipe member 32 is larger than the diameter of second pipe member 34. First pipe member 32 circumscribes second pipe member 34. Uphole support 36 and downhole support 38 extend radially outward from an outer surface of second pipe member 34.

Looking at FIGS. 2-3, bearings 40 can be positioned between first pipe member 32 and second pipe member 34. Bearings 40 can be ball bearings. An end bearing 42 can be located between an end surface of first pipe member 32 and a support member. As an example, end bearing 42 can be located between an uphole end of first pipe member 32 and uphole support 36. End bearing 42 can alternately be located between a downhole end of first pipe member 32 and downhole support 38. Bearings 40 can rotate with second pipe member 34 about a central axis of second pipe member 34. As an example, bearings 40 can be retained with second pipe member 34 by conventional bearing retention means.

Side bearing 44 is located between first pipe member 32 and second pipe member 34. In the example embodiment of FIG. 2, side bearing 44 can be located between an outer diameter surface of first pipe member 32 and an inner diameter surface of second pipe member 34. Side bearing 44 rotates with second pipe member 34 around an outer diameter surface of first pipe member 32. In the example embodiment of FIG. 3, side bearing 44 can be located between an outer diameter surface of second pipe member 34 and an inner diameter surface of first pipe member 32. Side bearing 44 can also be located radially exterior of first pipe member 32 within bearing housing 46. Side bearing 44 rotates with second pipe member 34 around an outer diameter surface of second pipe member 34.

Figure 5:
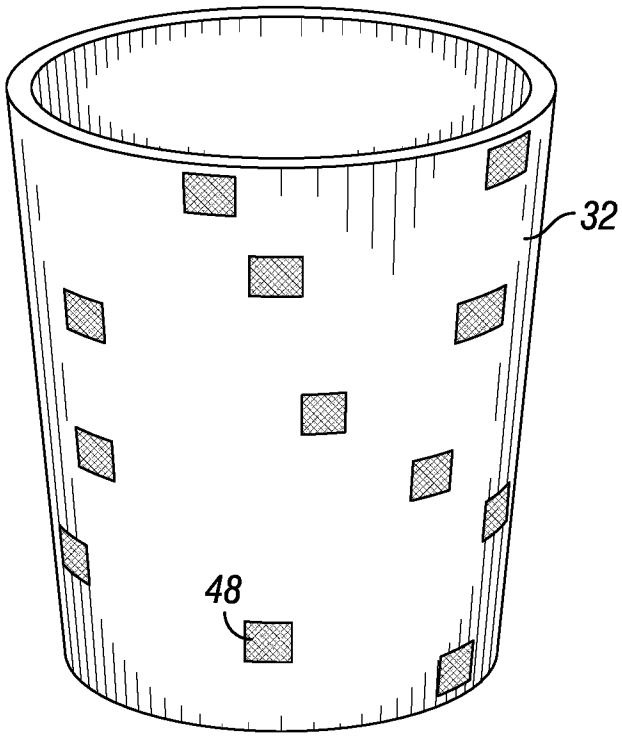
FIG. 5 is a perspective view of a first pipe member of an actuator assembly, in accordance with an embodiment of this disclosure.
Figure 4:
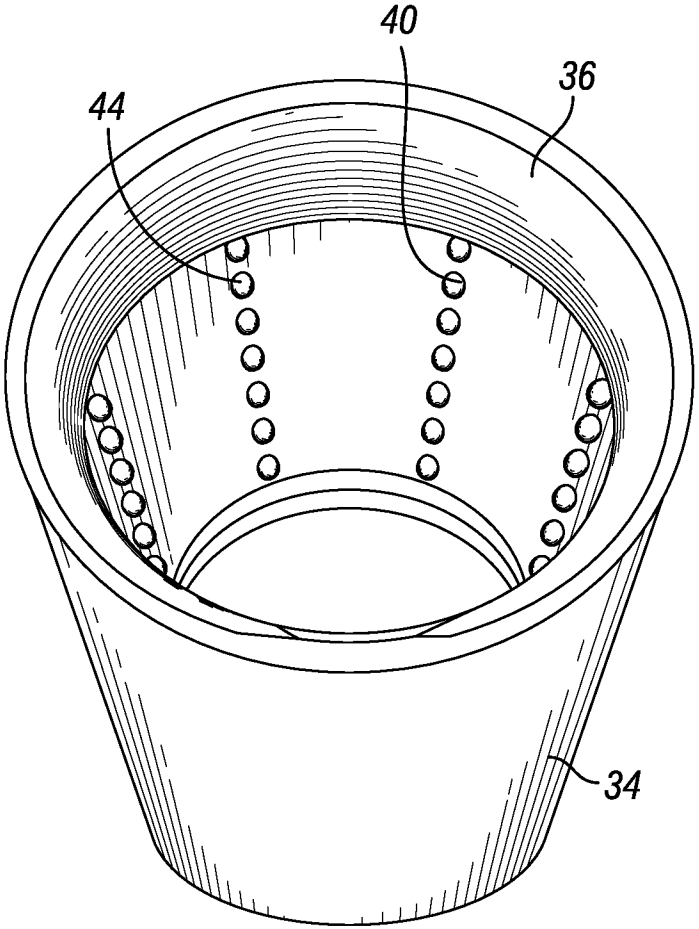
FIG. 4 is a perspective view of a second pipe member of an actuator assembly, in accordance with an embodiment of this disclosure.

Looking at FIG. 4, a series of side bearings 44 can be positioned in axially oriented rows spaced around an inner diameter surface of second pipe member 34. Looking at FIG. 5, an array of segments 48 are spaced around a surface of first pipe member 32. Segments 48 can be, for example, embedded in first pipe member 32 or be a coating applied to first pipe member 32. Segments 48 are positioned so that segments 46 are aligned with bearings 40. The segments are arranged in a specific configuration around first pipe member 32 which corresponds to signal patterns required to trigger or convey a specific command or instruction to a downhole tool, instrument, equipment, or other device. Looking at FIG. 2, as an example, segment 48 can be located on an outer diameter surface of first pipe member 32 and can be axially aligned with a side bearing 44. In alternate embodiments, segment 48 can be positioned at an uphole surface or downhole surface of first pipe member 32 and can be radially aligned with an end bearing 42.

Segment 48 can be formed of a first material and bearing 40 can be formed of a second material. The first material can be reactive to the second material. In an embodiment of the disclosure, as drill string 16 is rotated, second pipe member 34 will rotate relative to first pipe member 32. As an example, as drill string 16 is rotated, second pipe member 34 can rotate with drill string 16 and first pipe member 32 can remain static.

As bearing 40 rotates over and past segment 48, a reaction of the first material of segments 48 to the second material of bearing 40 can be sensed. The reaction of the first material of segments 48 to the second material of bearing 40 does not require a separate power source, such as a battery. As an example, the first material can have an opposite polarity as the second material. The voltage peaks are generated due to the exchange of charges between the first material of segments 48 to the second material of bearing 40. Certain materials are more inclined to gain electrons and other materials are more included to lose electrons. Electrons will be injected from the first material of segments 48 to the second material of bearing 40 if the first material of segments 48 has a higher polarity than the second material of bearing 40, resulting in oppositely charged surfaces. The first material of segments 48 to the second material of bearing 40 can be made of materials such as, polyamide, polytetrafluoroethylene (PTFE), polyethylene terephthalate (PET), polydimethylacrylamide (PDMA), polydimethylsiloxane (PDMS), polyimide, carbon nanotubes, copper, silver, aluminum, lead, elastomer, teflon, kapton, nylon or polyester.

Alternately, the first material of segments 48 can be a piezoelectric material and the second material can cause a mechanical stress on the first material. The first material of segments 48 can be, as an example, quartz, langasite, lithium niobate, titanium oxide, or any other material exhibiting piezoelectricity. In such an embodiment the piezoelectric segments are stressed when bearings 40 move over and along the surface of segments 48. The mechanical stresses experienced by the piezoelectric materials generate electric charges resulting in voltage peaks. The constant motion due to the rotation of drill string 16 while drilling wellbore 12 enables the piezoelectric segments to go through the motions of being stressed and released to generate voltage peaks.

Another alternate method of generating voltage peaks is by forming segments 48 from a magnetostrictive material such as terfenol-D, galfenol, metglas or any other material that shows magnetostricitve properties. The stress applied to the magnetostrictive segments 48 when bearings 40 move over and along segments 48 results in a change in the magnetic field of the magnetostrictive material. This induced magnetic field can be converted to a voltage by a planar pick-up coil or a solenoid that can be fabricated with segment 48.

Figure 6:
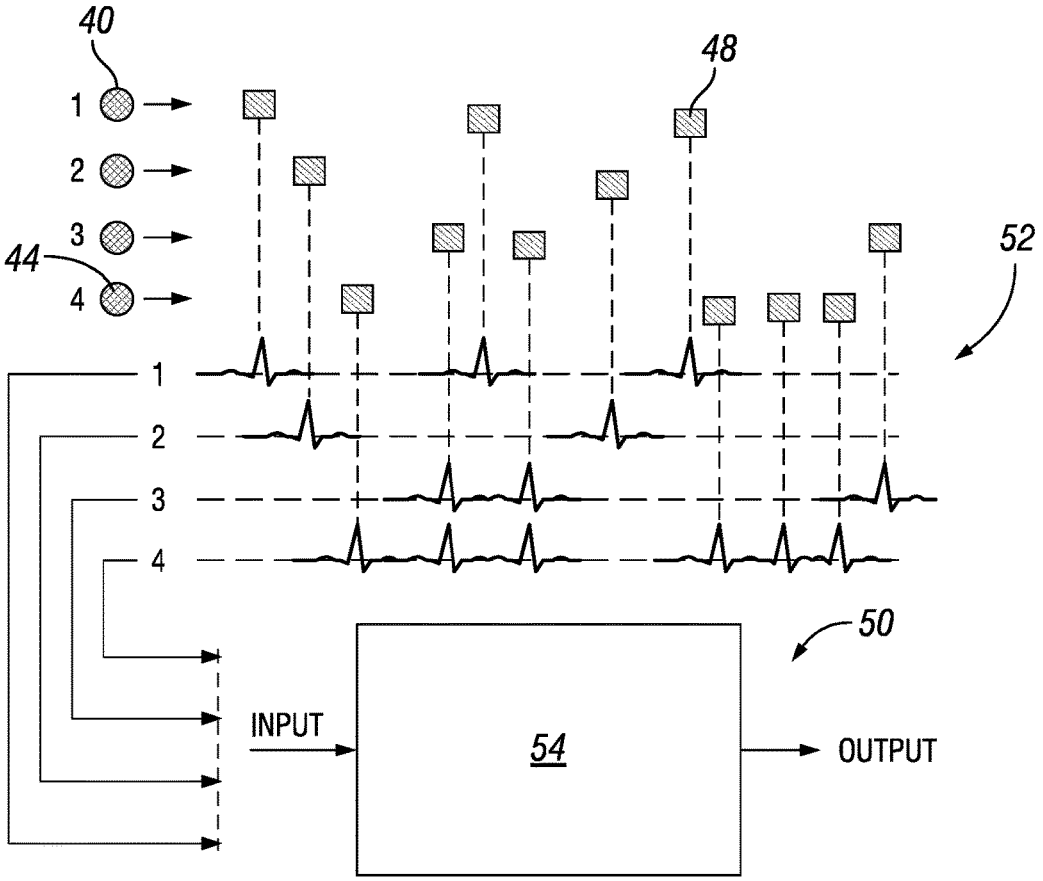
FIG. 6 is a schematic representation of a signal pattern generated by an actuator assembly, in accordance with an embodiment of this disclosure, shown with the drill pipe rotating in a single direction.

Looking at FIG. 6, each time a bearing 40 moves over and along a segment 48, a voltage peak is generated. The example amplitude and shape of the peak in FIG. 6 are for illustrative purposes and the amplitude and shape of the peak can be different depending on the size and shape of bearings 40 and segments 48 as well as the speed and frequency of rotation of second pipe member 34 relative to first pipe member 32.

The reaction of the first material of segments 48 to the second material of bearing 40 that is sensed as bearing 40 rotates over and past segment 48 and can be converted to a digital signal for interpretation by an electronics package 50 of actuator assembly 22 (FIG. 2). Electronics package 50 can include a digital logic circuit 54 for signal interpretation and can include an actuator system transceiver for signaling a downhole tool, instrument, equipment, and other device, based on the instructions received by way of the predetermined pattern of the rotation of drill string 16 (FIG. 1). The pattern can include, for example, a number of turns of drill string 16, a frequency, speed, or rate of rotation of drill string 16, or a direction of rotation of drill string 16.

Looking at FIG. 6 as drill string 16 rotates, continuous signal patterns 52 are generated with voltage peaks due to bearings 40 moving over and along segments 48, and with periods of no voltage when bearings 40 are rotating around the outer surface of first pipe member 32 where there are no segments 48. The voltage peaks are converted to digital signals by an analog-to-digital converter and connected as inputs to a digital logic circuit 54.

Digital logic circuit 54 can be a sequential logic circuit, where the output is not only a function of the inputs but is also a function of a sequence of past inputs. In order to store past inputs, sequential circuits have state or memory. Such features allow actuator assembly 22 to interpret the sequence of voltage peaks over time and provide a control signal to a downhole tool, instrument, equipment, and other device to perform a specific action.

Figure 7:
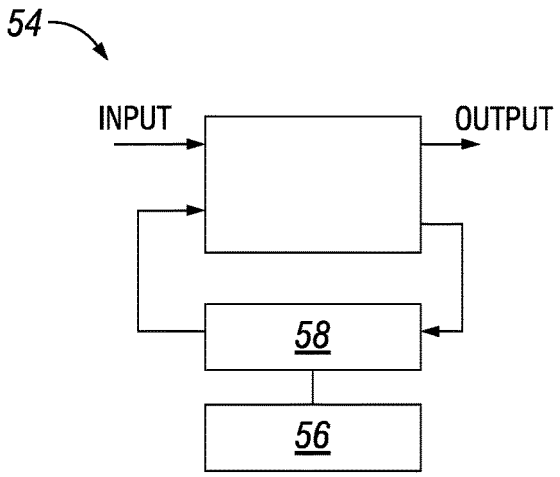
FIG. 7 is a schematic representation of a digital logic circuit of an actuator assembly, in accordance with an embodiment of this disclosure.

The sequential logic circuits can be synchronous, asynchronous or a combination of both. Looking at FIG. 7, synchronous sequential circuits have a clock 56. Memory 58 is connected to clock 56. Memory 58 receives inputs of all of the memory elements of the circuit, which generate a sequence of repetitive pulses to synchronize all internal changes of state. There are two types of sequential circuits, pulsed output and level output. In pulsed output circuits the output remains throughout the duration of an input pulse or the clock pulse for clocked sequential circuits. In level output sequential circuits the output changes state at the initiation of an input or clock pulse and remains in that state until the next input or clock pulse.

Figure 8:
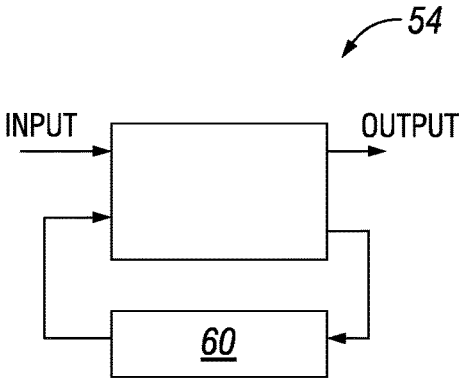
FIG. 8 is a schematic representation of a digital logic circuit of an actuator assembly, in accordance with an alternate embodiment of this disclosure.

Looking at FIG. 8, asynchronous sequential circuits do not have a periodic clock and the outputs change directly in response to changes in the inputs. Asynchronous sequential circuits are faster because they are not synchronized by a clock and the speed to process the inputs is only limited by the propagation delays of the logic gates in feedback loop 60 used in the circuit. However, asynchronous sequential circuits are harder to design due to timing problems arising from time-delay propagation not always being consistent throughout the stages of the circuit. The digital logic circuits can be implemented as an integrated circuit (IC) such as a field-programmable gate array (FPGA), application-specific integrated circuit (ASIC), complex programmable logic device (CPLD) or system on a chip (SoC).

Looking at FIG. 6, bearings 40 are side bearings 44 and second pipe member 34 is rotating in a single direction relative to first pipe member 32. During the drilling process the signals will have the same sequences with peak voltage amplitudes followed by periods of zero or very low voltage since drill string 16 will be rotating a single direction, at approximately the same speed. In embodiments of this disclosure drill string 16 can, as an example, be rotated in an anti-clockwise direction to drill wellbore 12 (FIG. 1).

Figure 9:
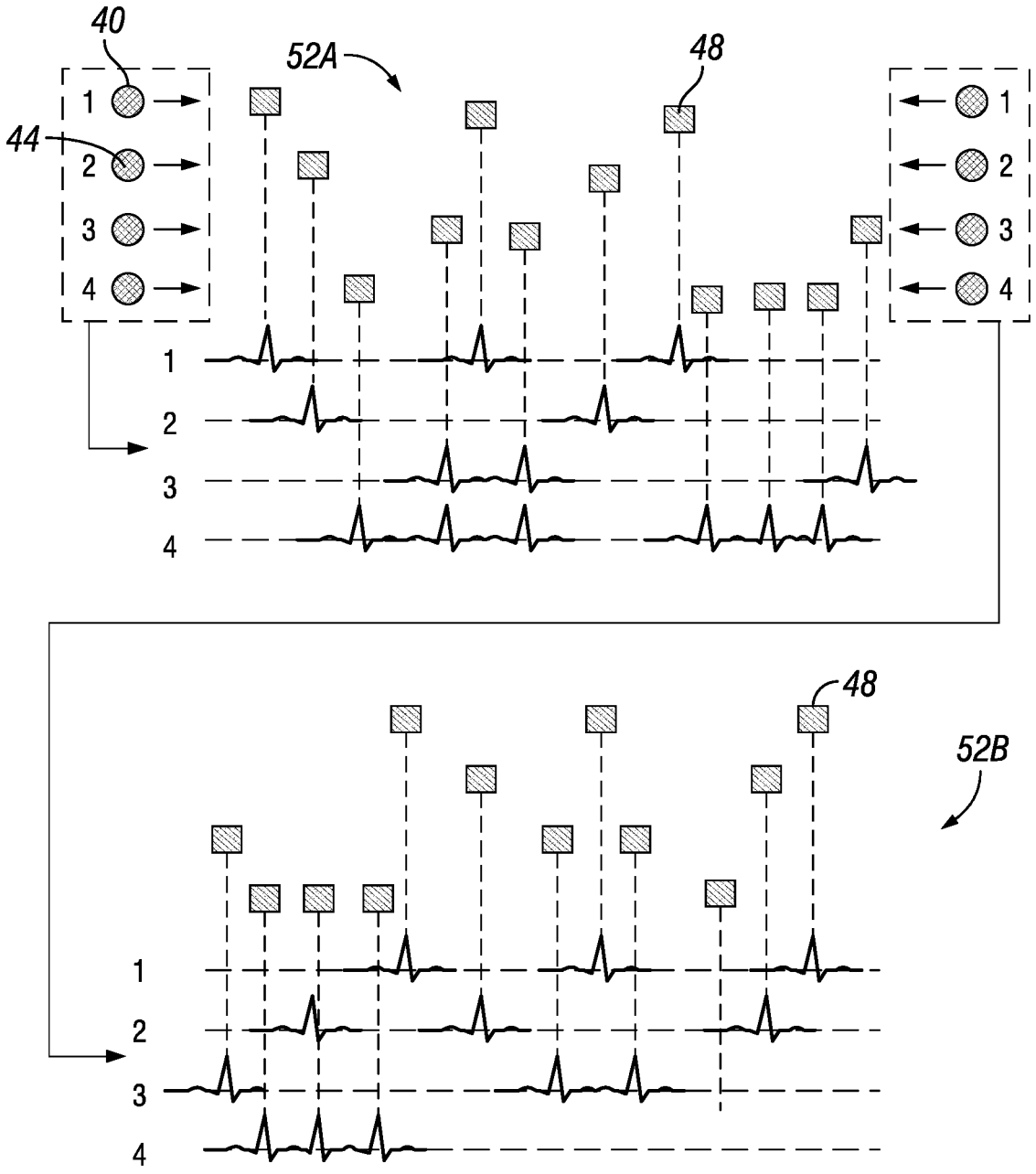
FIG. 9 is a schematic representation of continuous signal patterns generated by an actuator assembly, in accordance with an embodiment of this disclosure, shown with the drill pipe rotating in both an anticlockwise and clockwise direction.

Digital logic circuit 54 will compare the signal sequences over a given time period, clock cycle or fixed set of rotations and make a decision to enable, disable or perform no action in relation to a downhole tool, instrument, equipment, or other device. Actuator assembly 22 can be programmed to perform no action if the signal patterns are the same over the comparison period. However, if the direction of rotation is changed from anticlockwise to a clockwise direction as shown in FIG. 9 then the sequence of signals changes. This change in the sequence of voltage peaks can be utilized to develop unique code sequences to execute various downhole process.

Looking at FIG. 9, continuous signal patterns 52A are a result of drill string 16 being rotated in an anticlockwise direction so that second pipe member 34 rotates anticlockwise relative to first pipe member 32. When drill string 16 changes direction and rotates in a clockwise direction, second pipe member 34 rotates clockwise relative to first pipe member 32. The resulting continuous signal patterns 52B has a different pattern than continuous signal patterns 52A. Digital logic circuit 54 can recognize this change in pattern.

Actuator assembly 22 can be controlled from the surface. For example, during drilling operations bearings 40 move along and over segments 48 in an anticlockwise direction. If the sequence has to be changed to actuate a downhole tool, instrument, equipment, or other device, then drilling can be ceased, the drill bit can be lifted off the bottom of wellbore 12 and the drill string 16 can be rotated from the surface in a clockwise direction. Digital logic circuit 54 of actuator assembly 22 will recognize the difference in the signal sequence patterns and send a control signal to the downhole tool, instrument, equipment, or other device to perform an appropriate action.

When the drill bit is off the bottom of wellbore 12, drill string 16 can be rotated anticlockwise or clockwise to generate a large number of signal sequence patterns, which can be translated to perform different functions. Moreover, there can be multiple actuator assembly 22, each with unique segment patterns, placed at one or various locations in drill string 16. Therefore, a number of downhole tools, instruments, equipment, or other devices can be controlled and triggered from the surface.

An alternate method of generating a unique signal sequence patter is by changing the frequency of the rotation of drill string 16 in the anticlockwise direction, the clockwise direction, or in both directions, over one or multiple cycles. The rotation speed can be i) increased and then decreased or decreased and increased in one direction; ii) increased in the anticlockwise direction and decreased in the clockwise direction; iii) increased in the clockwise direction and decreased in the anticlockwise direction; or iv) any combination of increase/decrease in anticlockwise/clockwise directions.

In other alternate embodiments, the size and shape of segments 48 can be changed to generate signals of different amplitudes, widths and shapes. These signal patterns can then be used to identify the direction of rotation of the drill string assembly. In such a case digital logic circuit 54 can recognize the direction of rotation and initiate action to actuate a downhole tool, instrument, equipment, or other device after a specific number of rotations. Digital logic circuit 54 can also compare rotation directions over a specific number of rotations.

Figure 10:
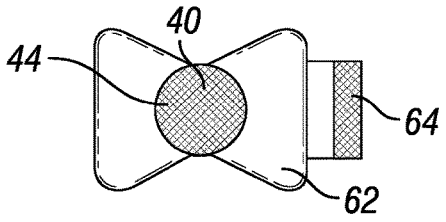
FIG. 10 is an elevation view of a bearing assembly of an actuator assembly, in accordance with an embodiment of this disclosure.
Figure 11:
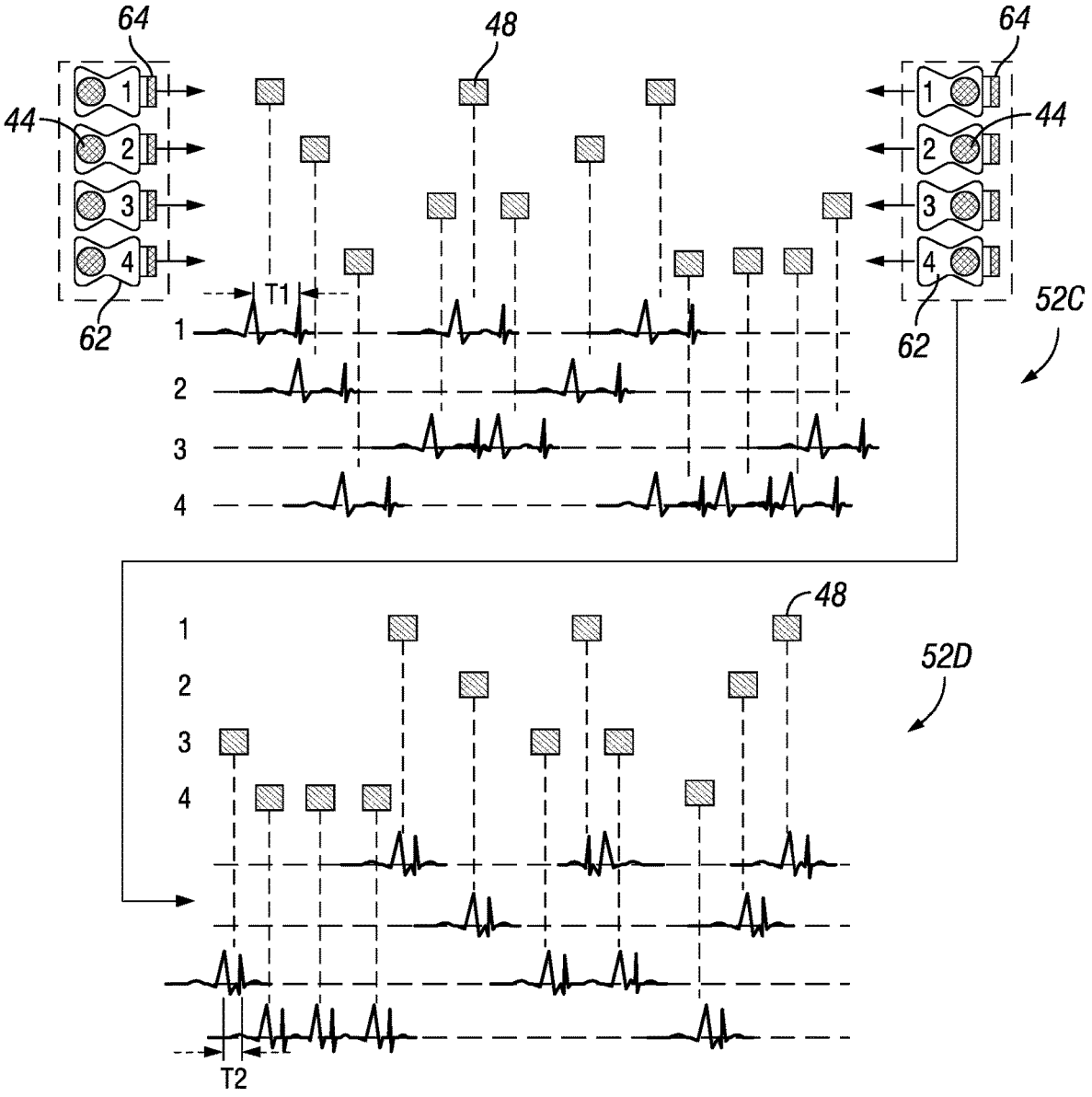
FIG. 11 is a schematic representation of continuous signal patterns generated by an actuator assembly, in accordance with an alternate embodiment of this disclosure, shown with the drill pipe rotating in both an anticlockwise and clockwise direction.

In yet other alternate embodiments, looking at FIGS. 10-11, another method to distinguish the direction of rotation of drill string 16 is to provide bearings 40 within latch slot 62. Latch slot 62 is a slot within second pipe member 34. Bearings 40, which are side bearings 44, will shift to the side of latch slot 62 relative to the direction of angular acceleration created by the rotation of drill string 16. On one side of latch slot 62 is cylindrical roller bearing 64.

The rotation of drill string 16 will cause side bearing 44 to move within latch slot 62 in a direction that is opposite to the direction of the rotation of drill string 16. As an example, when drill string 16 is rotating in an anticlockwise direction side bearing 44 is driven in a clockwise direction within latch slot 62 resulting in continuous signal patterns 52C. When drill string 16 is rotating in a clockwise direction side bearing 44 is driven in an anticlockwise direction within latch slot 62 resulting in continuous signal patterns 52D. The presence of the smaller cylindrical roller bearing 64 results in a peak of shorter width because cylindrical roller bearing 64 is in contact with segment 48 for a shorter duration of time compared to side bearings 44.

When drill string 16 is rotating in an anticlockwise direction side bearing 44 is further away from cylindrical roller bearing 64 compared to when drill string 16 is rotating in the clockwise direction. Therefore, when drill string 16 is rotating in an anticlockwise direction the time difference T1 between the peak due to side bearing 44 moving along a segment 48 and the peak due to cylindrical roller bearing 64 moving along the segment 48 is larger than the time difference T2. T2 is the time difference between the peak due to side bearing 44 moving along a segment 48 and the peak due to cylindrical roller bearing 64 moving along the segment 48 when drill string 16 is rotating in a clockwise direction. Therefore continuous signal patterns 52C are not only different from continuous signal patterns 52D due to drill string 16 rotating in a opposite direction, but because time difference T1 and time difference T2, which can be utilized to identify the direction of rotation of drill string 16.

Figure 12:
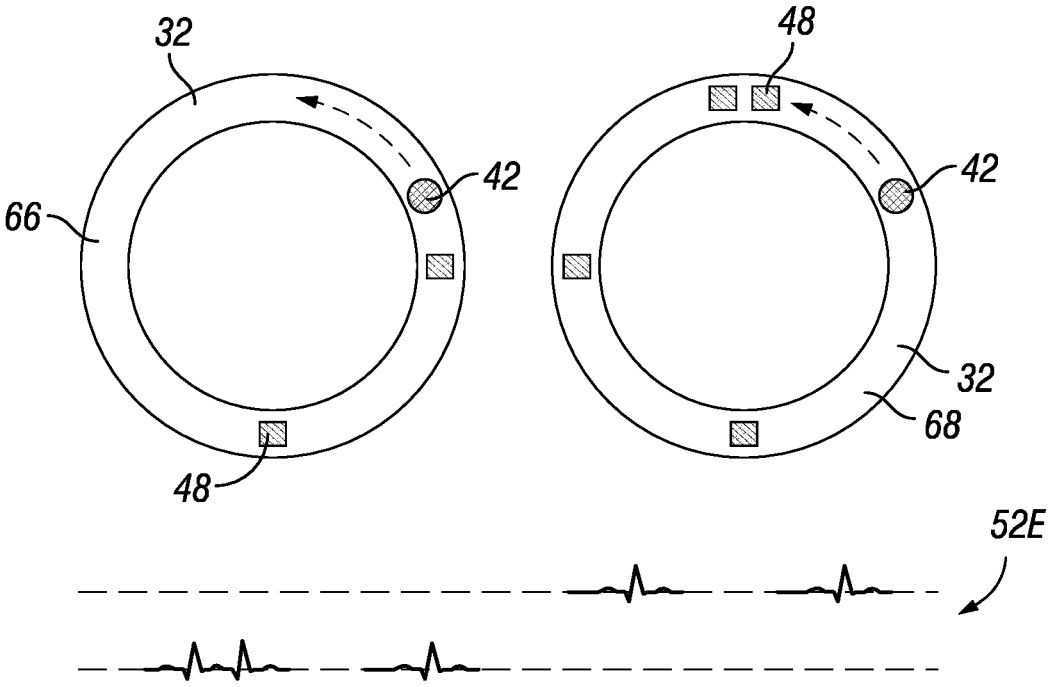
FIG. 12 is a is a schematic representation of continuous signal patterns generated by end bearings of an actuator assembly, in accordance with an alternate embodiment of this disclosure, shown with the drill pipe rotating in an anticlockwise direction.
Figure 13:
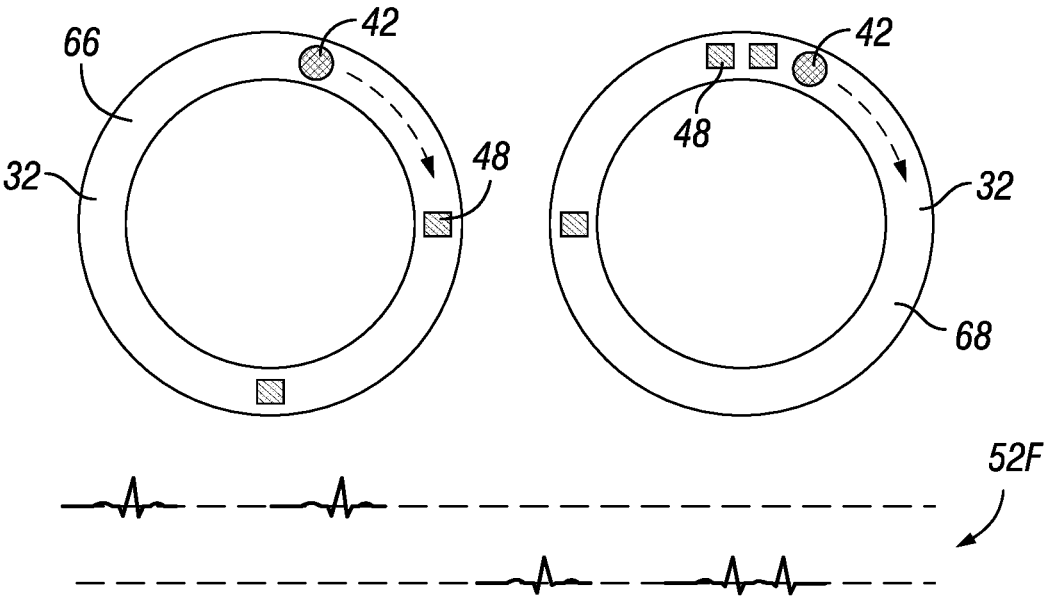
FIG. 13 is a is a schematic representation of continuous signal patterns generated by end bearings of an actuator assembly, in accordance with an alternate embodiment of this disclosure, shown with the drill pipe rotating in a clockwise direction.

In still other embodiments, a unique signal pattern can be generated by segments 48 that are located at the ends of first pipe member 32. Looking at FIGS. 12-13, uphole end 66 of first pipe member 32 can include a series of segments 48 and downhole end 68 of first pipe member can include different patter of a series of segments 48. As end bearings 42 move along and over segments 48, a signal pattern is generated. When drill string 16 is rotated anticlockwise, then second pipe member rotates in a direction anticlockwise relative to first pipe member 32 and continuous signal patterns 52E of FIG. 12 are generated. When drill string 16 is rotated anticlockwise, then second pipe member rotates in a direction anticlockwise relative to first pipe member 32 and continuous signal patterns 52F of FIG. 13 are generated.

During drilling operations, charges are constantly being produced due to bearings 40 moving over and along segments 48, especially while drilling. These charges not only generate signal patterns, but can also be converted from an analog signal to a digital signal by a bridge rectifier and stored in a di-electric capacitor de-rated for use at high temperatures, or can be stored in a ceramic, an electrolytic or a super capacitor. By storing the energy in a capacitor, actuator assembly 22 can also act as a power source.

Signal patterns generated by actuator assembly 22 can be used to instruct actuator assembly 22 to signal a variety of downhole tools, instruments, equipment, or other devices. As an example, actuator assembly 22 can be used for actuating downhole circulation subs to facilitate drilling and wellbore cleaning operations. Actuator assembly 22 can be used to send a trigger signal to open the circulation sub by sliding a sleeve or opening a valve to divert the drilling fluid directly into the annulus. This operation increases drilling fluid flow in the annulus and aids wellbore cleaning and can also split flow between the annulus and the drill string assembly. Once the operation is completed, actuator assembly 22 can be sent another trigger signal to close the circulation sub.

In alternate embodiments, actuator assembly 22 can be used for actuating bypass valves at a selected depth below fractures so that lost circulation material can be pumped through the bypass valves to plug the fractures. After the operation, instructions are conveyed from the surface through actuator assembly 22 to close the valves immediately of after a certain period of time. Similar operations can be performed to change the drilling fluid or to pump cement into the wellbore at desired depths. Actuator assembly 22 can further be utilized to activate and deactivate flapper valves and stimulation sleeves.

In other alternate embodiments, actuator assembly 22 can be used for actuating drilling reamers for increasing the size of the wellbore below casing. A drilling underreamer is a tool with cutters that is located behind a drill bit. Reamers are utilized to enlarge, smooth and condition a wellbore for running casing or completion equipment without any restrictions. Instead of pulling the drill string assembly out of the well when problems arise downhole, a reamer can be activated by actuator assembly 22. The underreamer then extends and drills through with the drill bit. Another trigger signal can be sent from the surface to actuator assembly 22 retract the underreamer. Actuator assembly 22 can be programmed to extend or retract reamers in several finite steps depending on the desired diameter of the wellbore.

In still other alternate embodiments, actuator assembly 22 can be used to expand and retract casing scrapers. Casing scrapers are utilized to remove debris and scale left by drilling fluids on the internal casing. Casing scrapers can be run with a drilling assembly in retracted mode while drilling an open hole section. The scrapers can be expanded at any time, for example when tripping out of hole, to scrape internal casing or critical zones in internal casing.

In yet other alternate embodiments, actuator assembly 22 can be used to expand and contract an inflatable, production, or test packer. Expanded packers seal the wellbore to isolate zones in the wellbore and also function as a well barrier. Production or test packers are set in cased holes while inflatable packers are set in both open and cased holes.

Actuator assembly 22 can alternately be used for sending command signals from the surface to set liner hangers.

Looking at FIG. 1, signal patterns generated by actuator assembly 22 can also be used to instruct actuator assembly 22 to transmit a swarm release signal to release certain of the sensors 26 from sensor compartment 24.

Figure 14:
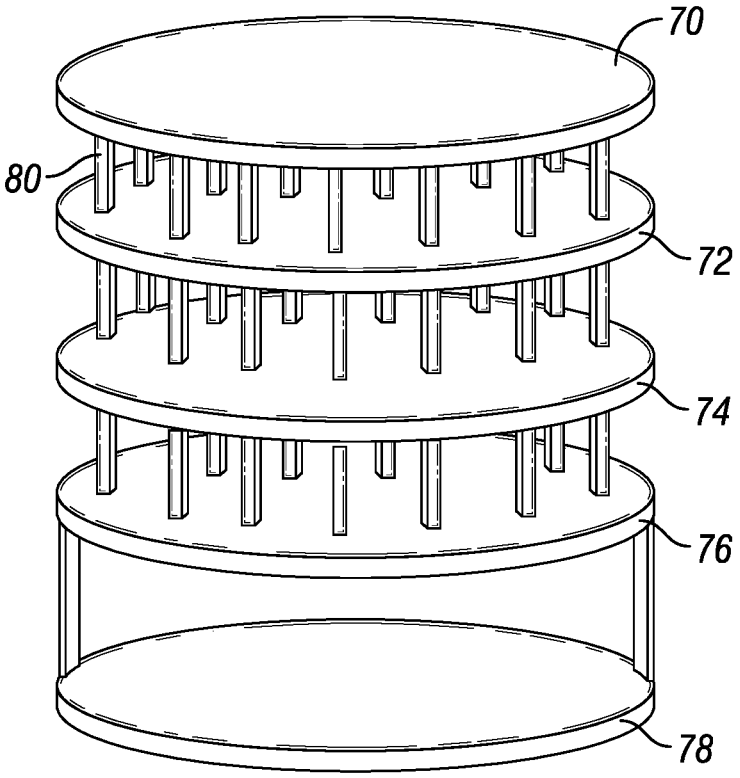
FIG. 14 is a detailed perspective view elements of a sensor, in accordance with an alternate embodiment of this disclosure.

Looking at FIG. 14, each sensor 26 within sensor compartment 24 can be a miniature microelectromechanical systems (MEMS) sensor. Sensor 26 can include the elements of microelectromechanical sensing element 70, microprocessor 72, signal processor 74, transceiver 76, and power source 78. Each of such components of sensor 26 can be a different high performing modules that is segmented and stacked. Each of such components of sensor 26 can be interconnected with short signal paths 80, which can be, for example, through-chip vias or through-silicon vias.

By using segmented modules no compromise has to be made with respect to material selection that could perform all of the functions. Each element can be formed a material best suited to the function of such element. In addition, each element has a separate surface area. Sensor 26 utilizes three dimensional large-scale integration technology that results in complex sensors with high integration densities and high performances that allow information transfer and for the supply of electric power among the stacked elements.

The heterogeneous three dimensional integration of the elements of sensor 26 further results in a significant reduction in the overall size of sensor 26 compared to some currently available sensors. The small size enables the packing of a large number of sensors 26 within sensor compartment 24.

Figure 15:
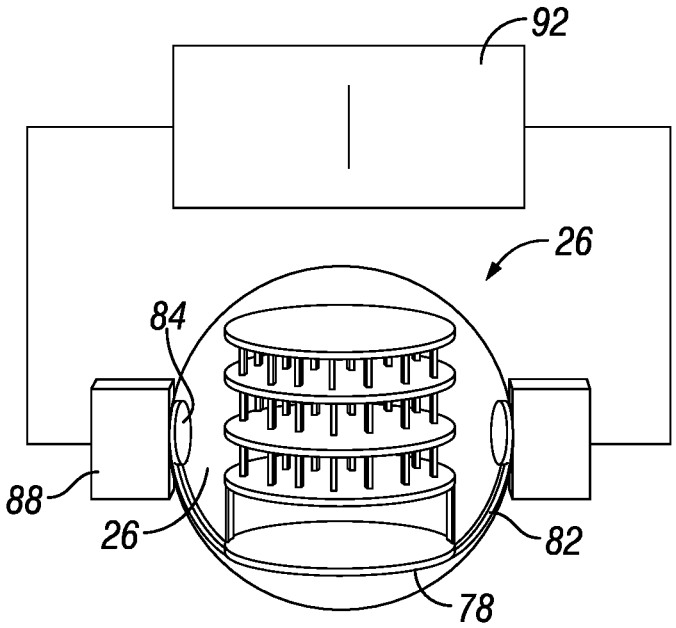
FIG. 15 is a perspective view of a sensor being held in position by a central power unit, in accordance with an embodiment of this disclosure.
Figure 16:
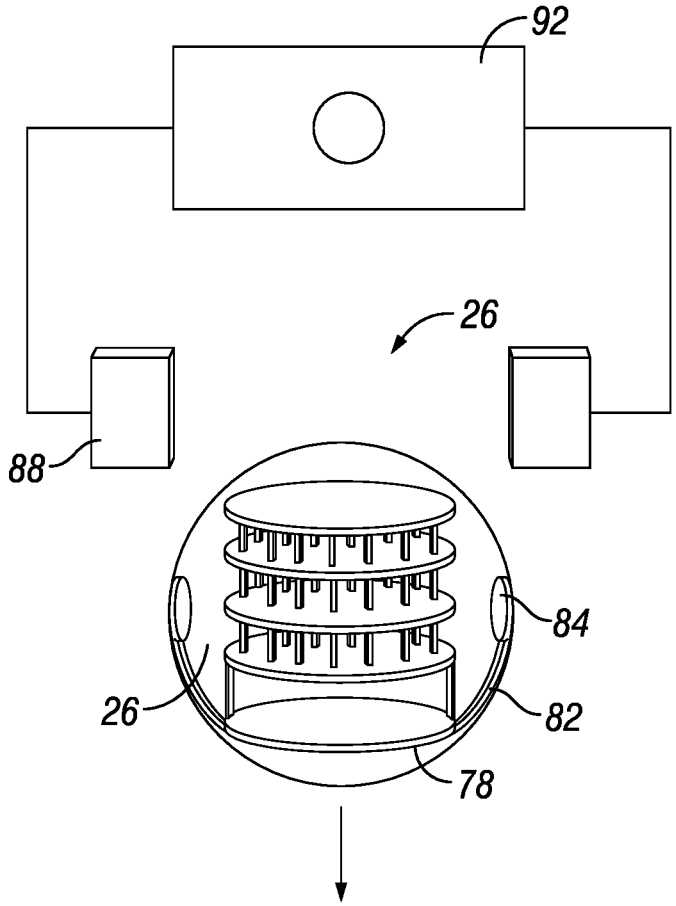
FIG. 16 is a perspective view of a sensor being released from a central power unit, in accordance with an embodiment of this disclosure.

Looking at FIGS. 15-16, the elements of sensor 26 can be located within outer shell 82. Outer shell 82 protects the elements of sensor 26 from harsh downhole environments. Outer shell 82 can be, as an example, a chemical coatings such as polymers or epoxy, resin-based materials, or any material that can withstand continuous exposure to the harsh downhole environment.

Sensor 26 can further include charge pad 84. Charge pad 84 can be connected to power source 78. Power source 78 can be a battery or a regular di-electric capacitor de-rated for use at high temperatures, a ceramic capacitor, an electrolytic capacitor, or a super capacitor. Power source 78 can further include an electronics package. Power source 78 can alternately be an energy harvesting source such as piezoelectric, magnetostrictive or electrostatic energy harvesting source, where energy can be harvested by the drilling fluid flow and vibrational energies encountered inside the wellbore.

Figure 17:
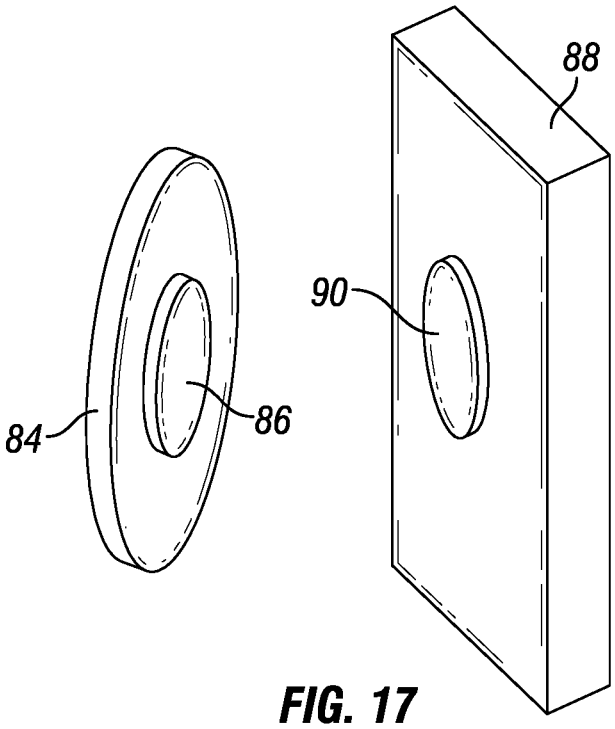
FIG. 17 is a perspective view of a sensor retention system, in accordance with an embodiment of this disclosure.

Charge pads 84 can further ensure that sensor 26 is immobilized. Looking at FIG. 17, in order to retain sensor 26 within sensor compartment 24, a soft ferromagnetic material 86 can be used to coat charge pads 84. Electrode 88 is part of sensor compartment 24. Electrode 88 can include a planar electromagnet 90. Soft ferromagnetic material 86 is a passive element that can be magnetized by applying an external magnetic field, and can be demagnetized by removing the external magnetic field.

Looking at FIG. 15, when central power unit 92 of sensor compartment 24 provides a current flow to electromagnet 90 (FIG. 17), electromagnet 90 produces a magnetic field, which magnetizes soft ferromagnetic material 86 (FIG. 17) and spatially concentrates the magnetic fields between soft ferromagnetic material 86 and electromagnet 90. Therefore, electrode 88 and charge pad 84 are attracted to each other and sensor 26 is retained within sensor compartment 24. Looking at FIG. 16, when central power unit 92 is turned off there is no power or current flow to electromagnet 90 and therefore there is no attraction between electrode 88 and charge pad 84. This results in the release of sensor 26 from its location inside sensor compartment 24.

Figure 18:
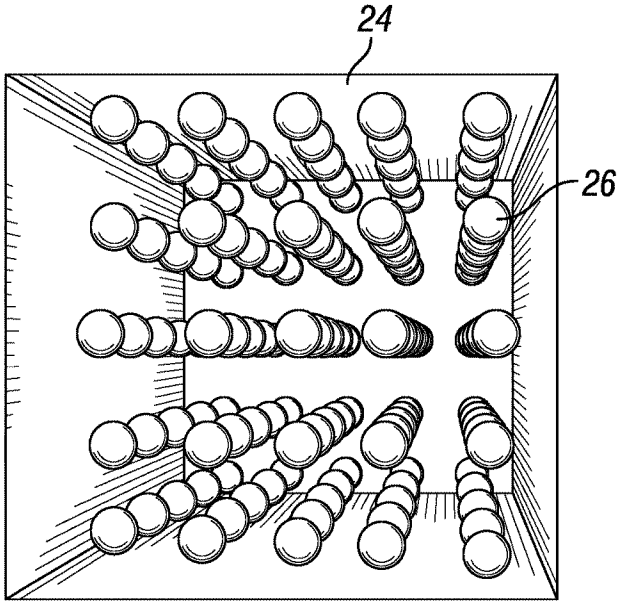
FIG. 18 is a schematic perspective view of a sensor compartment containing a plurality of sensors, in accordance with an embodiment of this disclosure.

Looking at FIG. 18, sensor compartment 24 can contain a swarm of sensors 26. Sensor compartment 24 can be located radially exterior of drill string 16. This will ensure that sensors 26 reach wellbore 12. Alternately, sensor compartment 24 can be located on the inner diameter surface of drill string 16. Sensor compartment 24 can be formed of materials such as steel, titanium, silicon carbide, aluminum silicon carbide Inconel, and pyroflask to reduce the effect of high temperature encountered in downhole environments.

Each sensor 26 in sensor compartment 24 can have a unique address. Such unique address can be accessed by a unique signal pattern sent from the surface to actuator assembly 22. Any amount of sensors of any type can be released into wellbore 12 at any given time during drilling operations. As an example, any number of and any combination of pressure, temperature, magnetic, capacitive, density, viscosity, humidity, accelerometer, gyroscope, tilt, proximity, resonance, acoustic, and optical sensors can be released into wellbore 12.

Sensors 26 can further be programmed to communicate with each other so that sensors 26 can collaboratively work together to perform a specific task. Sensor-to-sensor communication in a swarm enables large-scale, high resolution measurements.

Because sensors 26 are small they can be tightly packed into sensor compartment 24. Each sensor 26 can have a unique address inside sensor compartment 24. In order to minimize vibrations in the modules they can be mounted and installed in ways to isolate vibrations. As an example, mounts, springs, pads formed of rubber, elastomer, or foam, or wire ropes could be utilized when mounting the modules to isolate vibrations.

Figure 19:
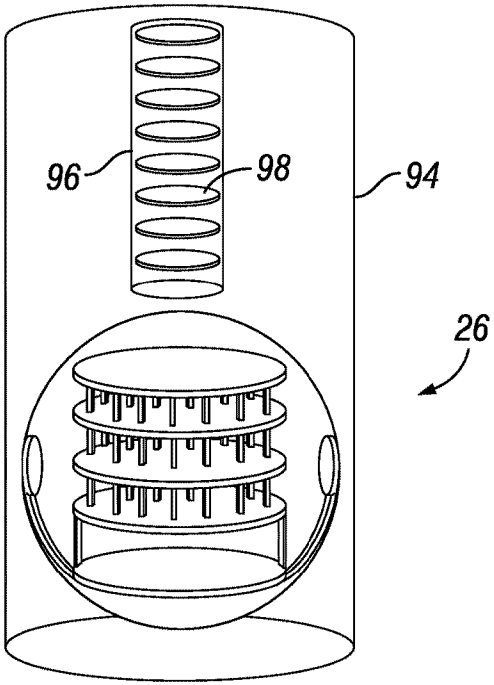
FIG. 19 is a perspective view of a sensor within a channel of the sensor compartment, in accordance with an embodiment of this disclosure.
Figure 20:
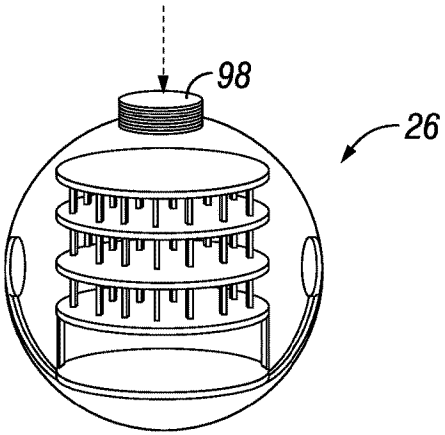
FIG. 20 is a perspective view of a sensor with weight elements, in accordance with an embodiment of this disclosure.

There may be times when it is desired for sensor 26 to be released from sensor compartment 24 and sink to the bottom of wellbore 12 to monitor conditions within or surrounding wellbore 12. In order for sensors 26 to sink to the bottom of wellbore 12, drilling fluid flow can be ceased or reversed. Looking at FIG. 19, sensor 26 can be mobilized inside channel 94 within sensor compartment 24. Channel 94 has conduit 96 with several weight elements 98. In order to increase the specific gravity of sensor 26 actuator assembly 22 can give commands to sensor compartment 24 to add a specific amount of weight elements 98 to sensor 26 through a latch and lock mechanism. Looking at FIG. 20, sensor 26 with added weight elements 98 can have a specific gravity that is greater than the specific gravity of the drilling fluid and can be released from channel 94 into wellbore 12 and sink to the bottom of wellbore 12.

In an example of operation, swarms of sensors 26 are packed inside sensor compartment 24. Each sensor 26 has a unique address within sensor compartment 24 and can be released individually. The address of each sensor 26 can be selected by delivery of a unique signal pattern, which will instruct actuation system to perform a function in relation to such sensor 26.

Figures 21A, 21B, 21C, 21D:
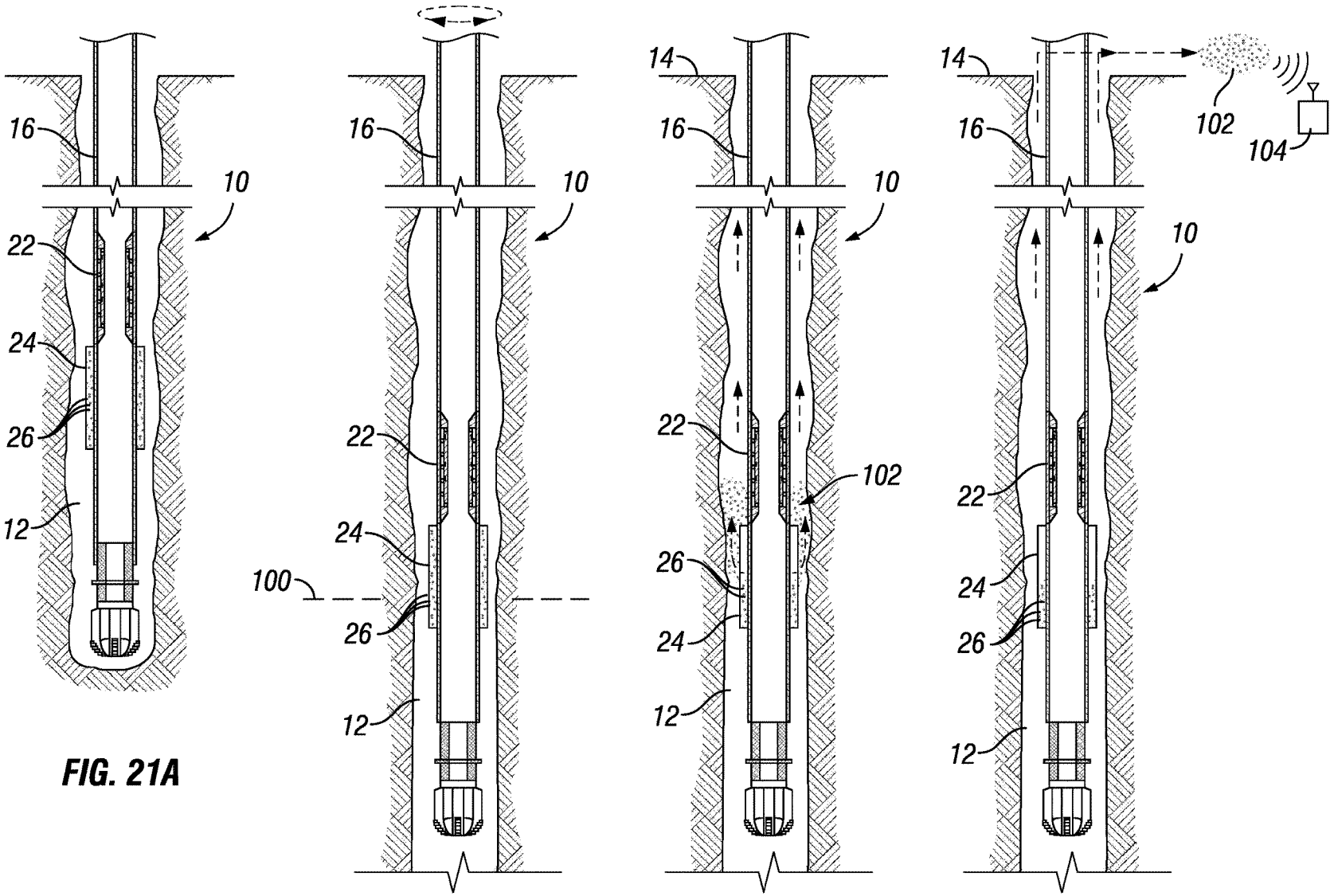
FIGS. 21A-21D are section views of an operation of the actuation assembly releasing a sensor swarm at a target depth, in accordance with an embodiment of this disclosure.

Looking at FIG. 21A, Drill string 16 with actuator assembly 22 and with sensor compartment 24 is extended into wellbore 12 of subterranean well 10. Drill string 16 is used to drill subterranean well 10, penetrating through a variety of downhole rock formations. Looking at FIG. 21B, in certain embodiments, drilling can be ceased after passing through a target depth 100 so that sensor compartment 24 is located adjacent to the target depth. During drilling operations, sensors 26 which are immobilized inside sensor compartment 24 can continuously acquire data from the downhole environment.

Looking at FIG. 21C, once the target depth 100 is reached by sensor compartment 24, the driller can pull the drill bit off the bottom of wellbore 12 and can rotate drill string 16 in different directions and frequencies to generate unique signal pattern from the surface that is a swarm release signal. The signal patterns are then translated into a specific action. As an example, the signal pattern can be an instruction to signal the ejecting all or a chosen number and type of sensors 26 from sensor compartment 24. Certain selected sensors 26 can exit sensor compartment 24 as a released swarm 102 into wellbore 12. Released swarm 102 travels uphole within wellbore 12 to terranean surface 14 with the drilling fluid flow. Looking at FIG. 21D, at terranean surface 14, a wireless data downloader 104 can extract data from released swarm 102 for analysis. Released swarm 102 can alternately be collected manually at terranean surface 14 and data can be downloaded from released swarm 102 by wired means.

Figure 22D:
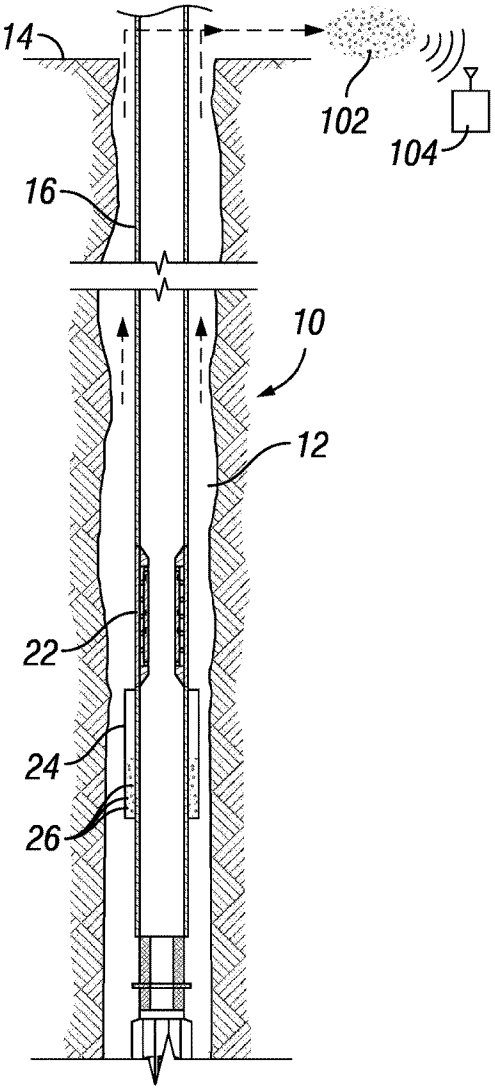
FIGS. 22A-22D are section views of an operation of the actuation assembly releasing a sensor swarm through a zone of interest, in accordance with an embodiment of this disclosure.
Figure 22C:
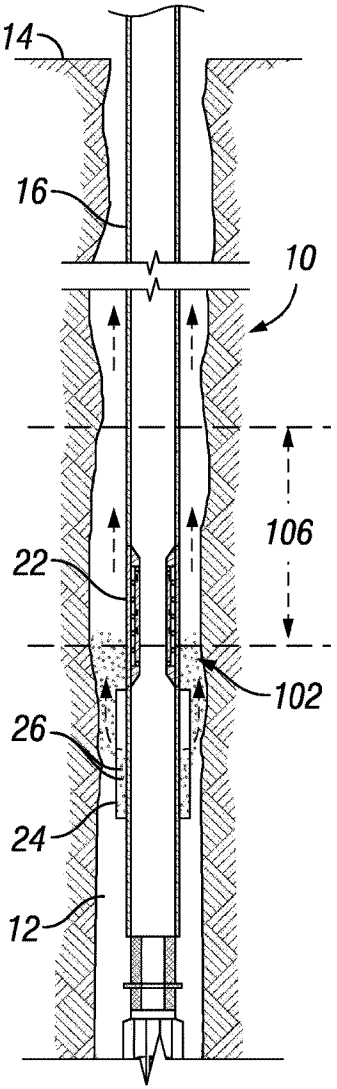
Figure 22B:
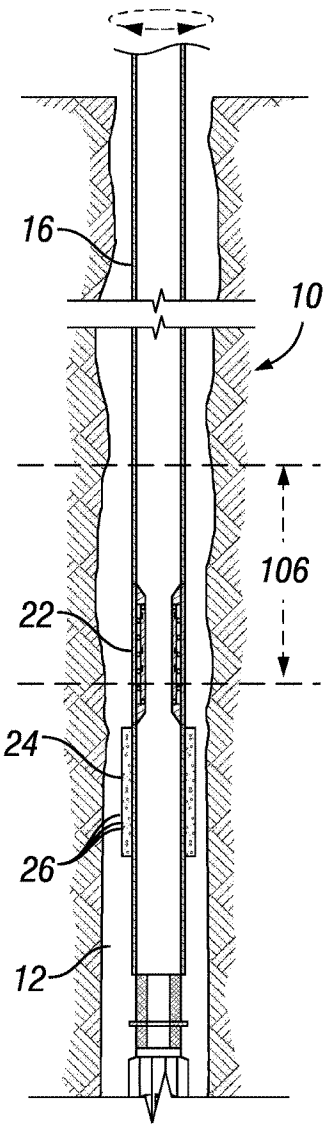
Figure 22A:
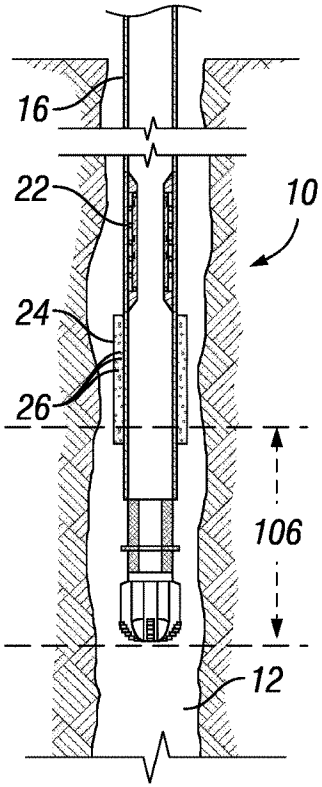

In an alternate example of operation, looking at FIG. 22A, drill string 16 can be used to drill wellbore 12 of subterranean well 10 and can encounter zone of interest 106. Zone of interest 106 can be, as an example, a zone that could either impact the drilling process in a positive or negative way. Looking at FIG. 22B, in order to obtain further information about zone of interest 106 the driller can drill ahead until sensors 26 located within sensor compartment 24 have passed through zone of interest 106, exposing sensors 26 to zone of interest 106. Then, drill string 16 can rotated from the surface to generate a signal pattern that is a swarm release signal to send instructions to actuator assembly 22 to cause sensor compartment 24 to deploy all or certain selected sensors from sensor compartment 24.

Looking at FIG. 22C, released swarm 102 has been released into wellbore 12. Released swarm 102 can travel uphole within wellbore 12. Looking at FIG. 22D, data from released swarm 102 is downloaded at terranean surface 14. Such data can provide information about zone of interest 106, which enables the driller to perform or initiate the appropriate action.

Figure 23C:
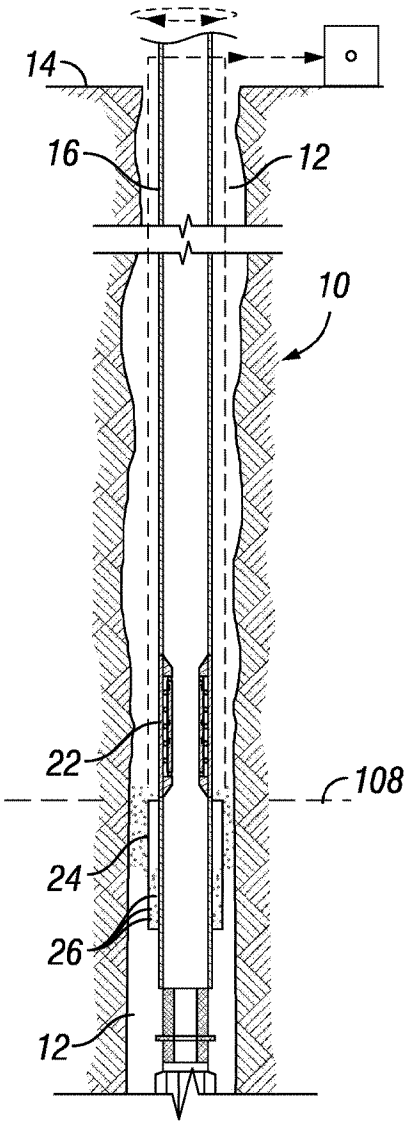
FIGS. 23A-23C are section views of an operation of the actuation assembly releasing a sensor swarm to detect a formation top, in accordance with an embodiment of this disclosure.
Figure 23B:
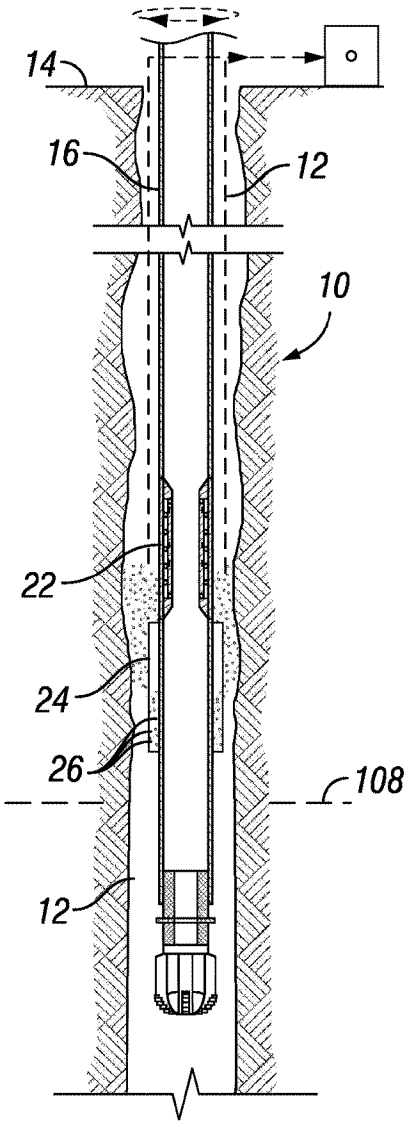
Figure 23A:
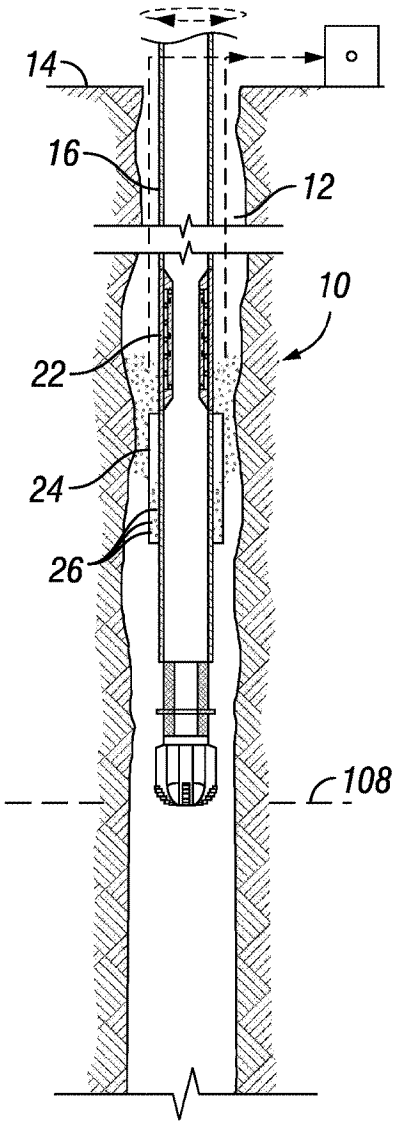

In yet another example of operation, looking at FIG. 23A-23C, drill string 16 can drill wellbore 12 until a new formation top 108 is reached. Identifying the location of formation tops can be used to revise mud weights or set casing. Drill string 16 can be rotated to generate a signal pattern that is a swarm release signal to instruct actuator assembly 22 to release certain sensors 26 at various depths. Released swam 102 will travel uphole within wellbore 12 to terranean surface 14. Data from released swam 102 will be processed, analyzed, and evaluated at terranean surface 14 by data processing system 110. Such data will inform an operator if formation top 108 has been reached. In the example of FIGS. 23A and 23B, data analyzed from released swarms 102 would indicate that formation top 108 had not been reached. In the example of FIG. 23C, data analyzed from released swarm 102 would indicate that formation top 108 had been reached.

Therefore embodiments of this disclosure provide systems and methods for actuating different devices, tools, and instruments from the surface it also enables the execution of discrete drilling workflows in real-time. Systems and methods of this disclosure can be controlled from the surface. The actuation system is a separate system that can be seamlessly integrated with downhole tools, devices, and instruments so that the actuation system does not displace existing drilling portfolios. The proposed actuation system and methods not only allows the redesign of workflows to increase drilling efficiency but can also facilitate drilling automation by closing one of the key technology gaps, communicating with and delivering trigger signals to downhole actuation systems in real-time. Because the signal patterns are unique to a specific operation, such as releasing a selected number or type of sensors, discrete drilling workflows can be executed without affecting other downhole tools instruments, devices, or operations.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A method for monitoring conditions within a wellbore of a subterranean well, the method including:

extending a drill string into the subterranean well from a terranean surface, the drill string having an actuator assembly, a sensor compartment, and a plurality of sensors located within the sensor compartment;

instructing the actuator assembly to transmit a swarm release signal to a central power unit of the sensor compartment so that the central power unit of the sensor compartment releases certain of the plurality of sensors from the sensor compartment; and transferring data from the certain of the plurality of sensors to a data processing system after the sensors reach the terranean surface: where each of the sensors of the plurality of sensors is retained within the sensor compartment by an electromagnet, and where releasing the certain of the plurality of sensors from the sensor compartment includes stopping a delivery of power to the electromagnet of each of the certain of the plurality of sensors.

2. The method of claim 1, where instructing the actuator assembly to transmit the swarm release signal to the central power unit includes rotating the drill string in a predetermined swarm release signal pattern.

3. The method of claim 1, where the actuator assembly has:

a first pipe member with a segment formed of a first material;

a second pipe member circumscribing the first pipe member; and a bearing positioned between the first pipe member and the second pipe member, the bearing formed of a second material, where the first material is reactive to the second material; where instructing the actuator assembly to transmit the swarm release signal to the central power unit includes rotating the first pipe member relative to the second pipe member and interpreting a pattern of a reaction of the segment as the bearing rotates past the segment.

4. The method of claim 1, where each of the sensors of the plurality of sensors is a miniature microelectromechanical systems sensor.

5. The method of claim 4, where the miniature microelectromechanical systems sensor includes a microelectromechanical sensing element, a microprocessor, a signal processor, a transceiver, and a power source located within an outer shell.

6. The method of claim 1, further including adding weight elements to the certain of the plurality of sensors before the sensor compartment releases the certain of the plurality of sensors from the sensor compartment.

7. The method of claim 1, where each of the plurality of sensors has a unique location identifier and instructing the actuator assembly to transmit the swarm release signal to the central power unit includes providing the unique location identifier of each of the certain of the plurality of sensors to be released from the sensor compartment.

8. A system for monitoring conditions within a wellbore of a subterranean well, the system including:

a drill string extending into the subterranean well from a terranean surface, the drill string having an actuator assembly, a sensor compartment, and a plurality of sensors located within the sensor compartment; and a data processing system located at the terranean surface operable to receive data from certain of the plurality of sensors; where the actuator assembly is operable to transmit a swarm release signal to a central power unit of the sensor compartment so that the central power unit of the sensor compartment releases the certain of the plurality of sensors from the sensor compartment where the actuator assembly has:

a first pipe member with a segment formed of a first material;

a second pipe member circumscribing the first pipe member; and a bearing positioned between the first pipe member and the second pipe member, the bearing formed of a second material, where the first material is reactive to the second material; and where the central power unit is operable to release the certain of the plurality of sensors from the sensor compartment by receiving the swarm release signal from the actuator assembly that is generated by rotating the first pipe member relative to the second pipe member and interpreting a pattern of a reaction of the segment as the bearing rotates past the segment.

9. The system of claim 8, where each of the sensors of the plurality of sensors is a miniature microelectromechanical systems sensor.

10. A method for actuating a downhole device within a subterranean well, the method including:

extending a tubular string into the subterranean well from a terranean surface, the tubular string having an actuator assembly;

instructing the actuator assembly to transmit a signal to the downhole device, directing the downhole device to perform a function; where the actuator assembly has:

a first pipe member with a segment formed of a first material;

a second pipe member circumscribing the first pipe member;

a bearing positioned between the first pipe member and the second pipe member, the bearing formed of a second material, where the first material is reactive to the second material; where instructing the actuator assembly to transmit the signal to the downhole device includes rotating the tubular string to rotate the first pipe member relative to the second pipe member in a predetermined pattern, and interpreting a resulting reaction of the segment as the bearing rotates past the segment.

11. The method of claim 10, where the segment is located on an outer diameter surface of the first pipe member and is axially aligned with a side bearing, the side bearing being located between the outer diameter surface of the first pipe member and an inner diameter surface of the second pipe member.

12. The method of claim 10, where the segment is positioned at and end surface of the first pipe member and is radially aligned with an end bearing, the end bearing being located between the end surface of the first pipe member and a support member secured to the second pipe member that extends radially from the second pipe member.

13. A system for actuating a downhole device within a subterranean well, the system including:

a tubular string extending into the subterranean well from a terranean surface, the tubular string having an actuator assembly; where the actuator assembly has:

a first pipe member with a segment formed of a first material;

a second pipe member circumscribing the first pipe member;

a bearing positioned between the first pipe member and the second pipe member, the bearing formed of a second material, where the first material is reactive to the second material; where the actuator assembly is operable to receive instructions to transmit a signal to the downhole device, directing the downhole device to perform a function; and the tubular string is operable to rotate the first pipe member relative to the second pipe member in a predetermined pattern, causing a resulting reaction of the segment as the bearing rotates past the segment for instructing the actuator assembly to transmit the signal to the downhole device.

14. The system of claim 13, where the segment located on an outer diameter surface of the first pipe member and is axially aligned with a side bearing, the side bearing being located between the outer diameter surface of the first pipe member and an inner diameter surface of the second pipe member.

15. The system of claim 13, further including a support member extending radially inward from an inner diameter surface of the second pipe member, the support member supporting the first pipe member within a central bore of the second pipe member.

16. The system of claim 15, where the segment is positioned at and end surface of the first pipe member and is radially aligned with an end bearing, the end bearing being located between the end surface of the first pipe member and the support member.

* * * * *